US006568106B2

(12) United States Patent
Takeuchi

(10) Patent No.: US 6,568,106 B2
(45) Date of Patent: May 27, 2003

(54) CHUTE FOR SNOW REMOVAL MACHINE

(75) Inventor: Masashi Takeuchi, Wako (JP)

(73) Assignee: Honda Giken Kogyo Kabushiki Kaisha (JP)

( * ) Notice: Subject to any disclaimer, the term of this patent is extended or adjusted under 35 U.S.C. 154(b) by 21 days.

(21) Appl. No.: 09/992,705

(22) Filed: Nov. 14, 2001

(65) Prior Publication Data

US 2002/0062582 A1 May 30, 2002

(30) Foreign Application Priority Data

Nov. 30, 2000 (JP) ..... 2000-365402

(51) Int. Cl.[7] ..... E01H 5/09
(52) U.S. Cl. ..... 37/262
(58) Field of Search ..... 37/260, 261, 262, 37/253, 254, 257, 258, 244, 249, 238, 242, 209, 213, 223

(56) References Cited

U.S. PATENT DOCUMENTS

| | | | | | |
|---|---|---|---|---|---|
| 1,816,589 | A | * | 7/1931 | Johnson | 37/256 |
| 2,871,585 | A | * | 2/1959 | Merry et al. | 37/243 |
| 3,497,263 | A | * | 2/1970 | Heth et al. | 406/162 |
| 4,138,829 | A | * | 2/1979 | Chase | 37/262 |
| 4,205,468 | A | * | 6/1980 | Greider | 37/260 |
| 4,694,594 | A | | 9/1987 | Thorud et al. | 37/244 |
| 4,761,901 | A | * | 8/1988 | Szafarz | 37/262 |
| 4,951,403 | A | * | 8/1990 | Olmr | 37/262 |
| 5,163,239 | A | * | 11/1992 | Lampe | 37/260 |
| 5,444,927 | A | * | 8/1995 | Sosenko | 37/260 |
| 6,058,629 | A | * | 5/2000 | Peterson et al. | 37/261 |
| 6,499,238 | B2 | * | 12/2002 | Kluck et al. | 37/261 |

FOREIGN PATENT DOCUMENTS

| | | |
|---|---|---|
| JP | 62063708 | 3/1987 |
| JP | 05045610 | 7/1991 |
| JP | 2000-64241 | * 2/2000 |
| JP | 2000-345526 | * 12/2000 |

* cited by examiner

*Primary Examiner*—Victor Batson
(74) *Attorney, Agent, or Firm*—Adams & Wilks

(57) ABSTRACT

A chute for a snow removal machine, for throwing raked-in snow to the left or right. The chute has a left chute and a right chute, which are branched in a forked shape. During operation, the direction in which to throw snow is changed by shifting a diverter valve.

4 Claims, 4 Drawing Sheets

CHUTE FOR SNOW REMOVAL MACHINE

FIELD OF THE INVENTION

This invention relates to an improved chute for a snow removal machine, for blowing snow raked in from a road surface in a desired direction.

BACKGROUND OF THE INVENTION

A conventional snow removal machine chute of this kind is disclosed, for example, in Japanese Patent Laid-Open Publication No. SHO-62-63708 (U.S. Pat. No. 4,694,594) or in Japanese Utility Model Laid-Open Publication No. HEI-5-45610.

SHO-62-63708 shows a snow removal machine having a single rotatable chute for blowing snow raked in with a paddle in a desired direction. The chute is rotated in a desired direction by manually rotating a grip provided at the distal end of a crank handle mounted to the snow removal machine, thereby rotating a drive gear ring through a worm provided at the proximal end of the crank handle. In the above chute rotating structure, it is necessary to rotate the crank handle through the grip to change the direction of the chute, which is time-consuming. Further, a plurality of gears and worms are required for the chute rotating structure, increasing the number of components, and thereby increasing the cost of the snow removal machine.

HEI-5-45610 shows a snow removal machine having a single rotational chute connected to the upper end of a fixed chute provided to the machine body. The rotational chute has a gear provided on the outer periphery of its proximal end. The rotational chute is rotated by driving a small motor, activating a gear mechanism engaging with the outer periphery gear. If the small motor malfunctions, a release device is activated, moving the outer peripheral gear and the gear mechanism out of engagement. Then a handle attached to the outer periphery of the rotational chute is manually rotated to rotate the rotational chute. That is, even if there is some problem with the small motor, the rotational chute can be rotated and oriented in a desired direction.

In normal operation, the rotational chute is rotated by the small motor. However, where frequent change in direction is required for the rotational chute, time consumed in rotating the rotational chute increases, resulting in long waiting time and deteriorating workability. Further, the use of the small motor requires a variety of electrical components, increasing the cost with the number of the electrical components, and thereby increasing the production cost of the snow removal machine.

SUMMARY OF THE INVENTION

It is an object of the present invention to provide a snow removal machine which has improved snow removing workability and is produced at a lower cost.

According to an aspect of the present invention, there is provided a chute for a snow removal machine, for guiding the throwing of snow raked in from a road surface in a desired direction, which comprises: a main chute uprightly provided on a body of the snow removal machine; a forked portion provided at an outlet of the main chute; a diverter valve provided in the forked portion; and a left chute and a right chute extending to the left and right from the forked portion, wherein the diverter valve is shifted to enable snow to be thrown from either the left chute or the right chute.

The chute has the diverter valve located at the outlet of the main chute and the left and light chutes. When the direction to which snow is to be thrown is changed from the left to the right, for example, during operation, the diverter valve is shifted to close the left and open the right, thereby transferring the snow to the right chute and blowing it to the right. Conversely, when the direction is switched to the left, the diverter valve is shifted to close the right and open the left. Thus the snow throwing direction can be changed in a moment, causing little waiting time and improving snow removing workability.

The chute comprises a simple structure formed of the main chute, the forked part, the diverter valve, and the left chute and the right chute, which allows for easy production of the snow removal machine.

Preferably, the diverter valve is shifted manually by a control lever connected to the diverter valve. The diverter valve may be made, for example, from a thin stainless steel material, a steel material, or a resin material.

BRIEF DESCRIPTION OF THE DRAWINGS

Preferred embodiments of the present invention will be described below, by way of example, with reference to the accompanying drawings, in which.

DETAILED DESCRIPTION OF THE PREFERRED EMBODIMENTS

Figure 1:
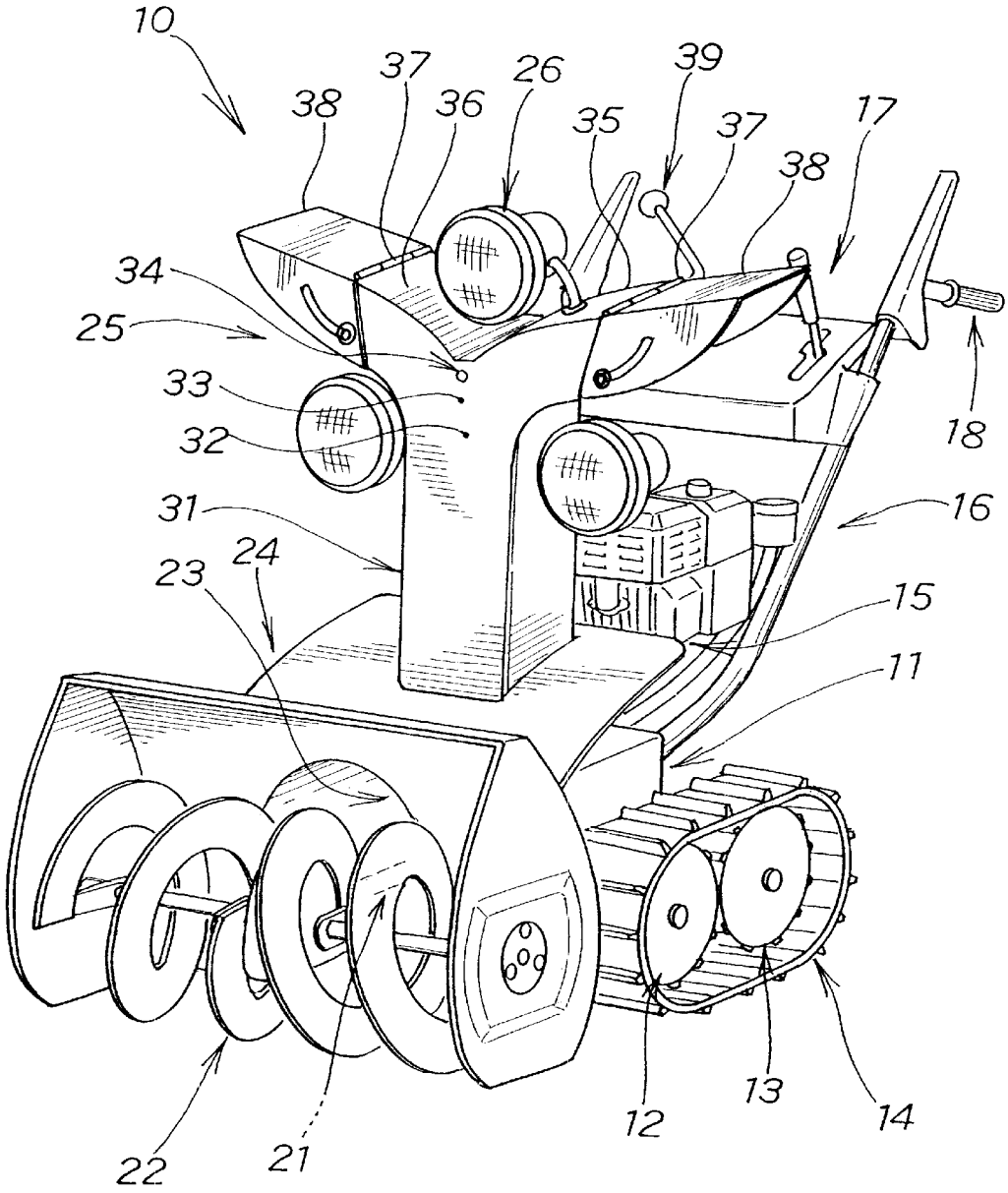
FIG. 1 is a perspective view of a snow removal machine with a chute according to a first embodiment of the present invention.

FIG. 1 shows a snow removal machine 10 having a body frame 11, right and left crawler belts 14, 14 (the right crawler belt is not shown) mounted to the right and left sides of the body frame 11 through right and left drive wheels 12, 12 (the right drive wheel is not shown) and right and left driven wheels 13, 13 (the right driven wheel is not shown), an engine 15 mounted on the body frame 11, operating handles 16, 16 attached to the rear of the body frame 11, a control panel 17 mounted between the operating handles 16, 16, right and left grips 18, 18 provided at rear portions of the operating handles 16, 16, a drive shaft 21 driven by the engine 15, an auger 22 connected to the front end of the drive shaft 21 for raking in snow laying on the road surface, a blower 23 for blowing off snow raked in by the auger 22, and a chute 25 mounted to a case 24 containing the auger 22 and the blower 23 for guiding snow blown off by the blower 23 to the outside. A plurality of headlights 26 is mounted to the chute 25.

The chute 25 has a main chute 31 uprightly mounted to the case 24 of the snow removal machine 10, a forked portion 33 extending right and left from an outlet 32 of the main chute 31, a diverter valve 34 provided in the forked portion 33, right and left chutes 35, 36 extending right and left from the forked portion 33, and angle adjustment chutes 38, 38 connected to the right and left chutes 35, 36 bendably through hinges 37, 37. Reference numeral 39 denotes a control lever for operating the diverter valve 34.

Figure 2:
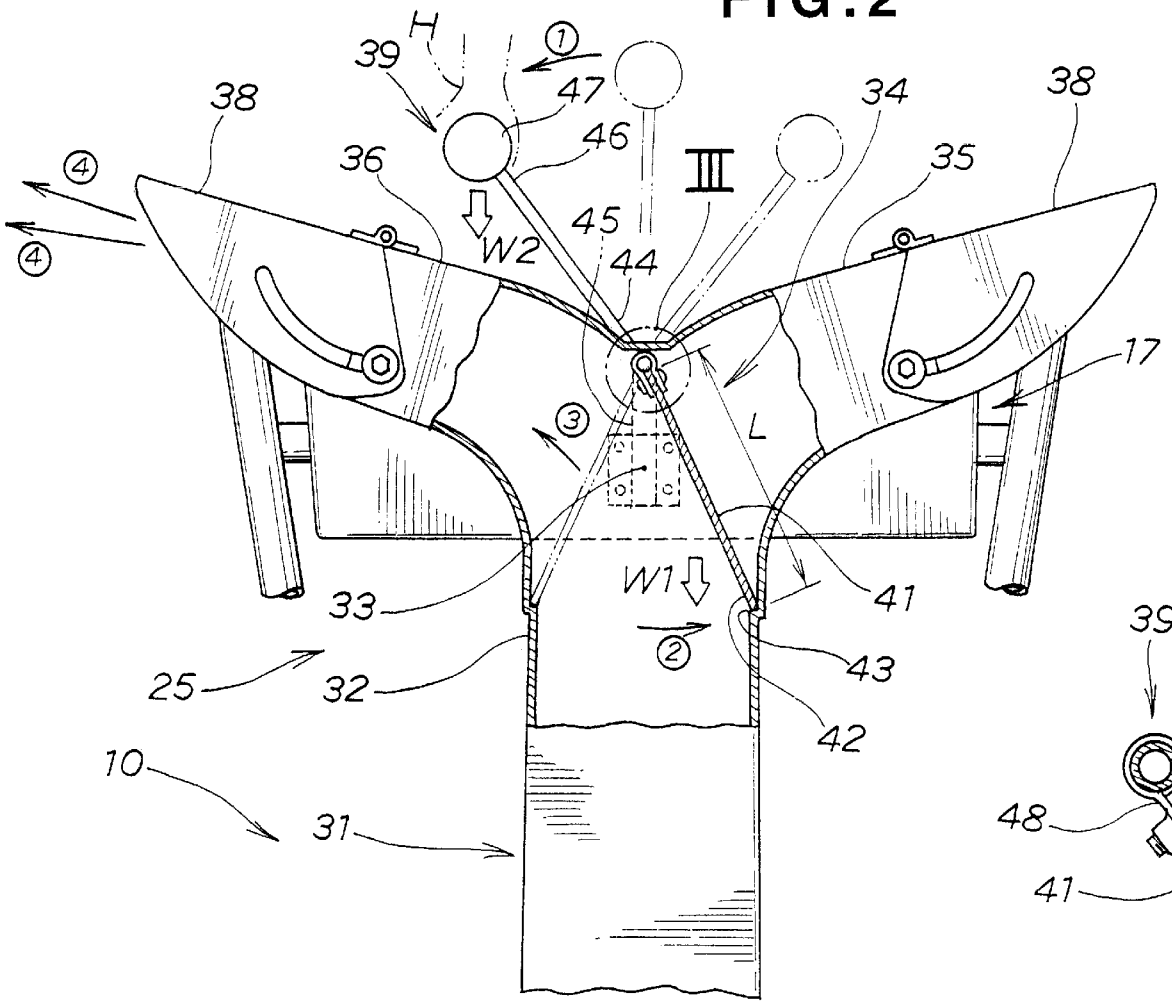
FIG. 2 is a partly sectional front view of the chute shown in FIG. 1.

FIG. 2 shows a partly sectional view of the chute 25 according to the first embodiment of the present invention.

In FIG. 2, the diverter valve 34 has a valve body 41 provided to the forked portion 33. Seat steps 43 with which a distal end 42 of the valve body 31 is brought into close contact are formed at the outlet 32 of the main chute 31. The diverter valve 34 is manually operated. The seat steps 43 reduce leakage and flow resistance.

The valve body 41 has a length L and a width (in a forward/backward direction) which allows the body 41 to make contact with the inner surface of the main chute 31. The valve body 41 has a weight W1. The material of the valve body 41 is a thin stainless steel plate or steel plate.

The control lever 39 has an L-shaped connecting rod 44. The connecting rod 44 is connected at one end to the valve body 41 and is supported at the other end on a supporting member 45. The supporting member 45 is mounted on the control panel 17. A grip 47 is provided at an end 46 of the rod 44. The grip 47 has a weight W2. The weight W2 is greater than W1 (W2>W1).

In the figure, the control lever 39 is turned to the right, opening the right chute 36.

Figure 3:
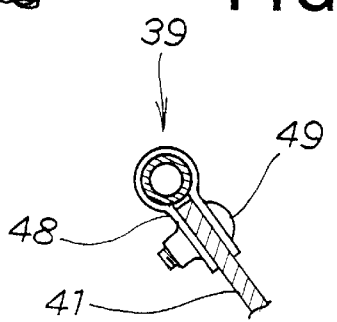
FIG. 3 is an enlarged view of a portion III shown in FIG. 2.

FIG. 3 shows details of the portion III shown in FIG. 2. The valve body 41 is attached to the control lever 39 via two mounting tools 48, 48 (the rear one is not shown) and screws 49, 49.

Now the function of the above-described snow removal machine chute will be described.

The function of the diverter valve 34 is described with reference to FIG. 2.

When the grip 47 of the control lever 39 is turned to the right as shown by arrow ① by a hand H, the valve body 41 is shifted as shown by arrow ②, opening the right chute and closing the left. Since the weight W2 of the grip 47 is greater than the weight W1 of the valve body 41, even when the hand H is moved off the grip 47, the distal end 42 of the valve body 41 is kept upwardly biased as shown by arrow ②, pressing the seat step 43. Thus the diverter valve 34 maintains this state. As a result, snow is transferred in the direction shown by arrow ③ and thrown from the right chute 36 to the right as shown by arrows ④, ④.

Conversely, when the grip 47 is turned to the left as shown in an imaginary line, the diverter valve 41 is shifted, opening the left chute and closing the right. As a result, snow is transferred to the left chute to be thrown from the left chute 35 to the left.

Figure 4:
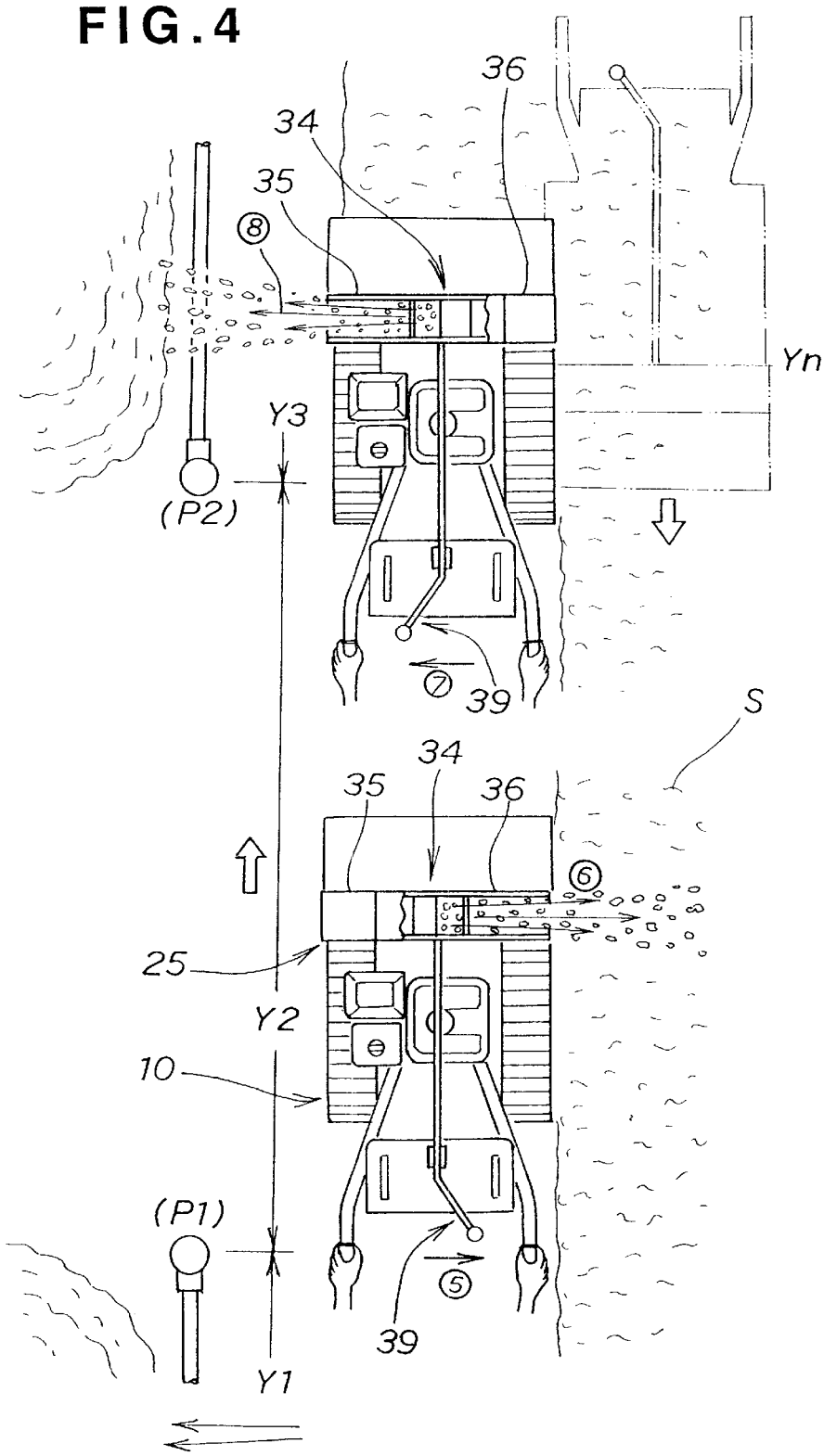
FIG. 4 is a functional diagram showing the snow removal machine in FIG. 1 in operation.

FIG. 4 exemplifies a snow removal manner with the snow removal machine shown in FIG. 1.

The chute 25 of the snow removal machine 10 is provided with the left chute 35 and the right chute 36. The figure shows that once snow S within the range of Y1 has been thrown to the left, the control lever 39 is turned to the right as shown by arrow ⑤, shifting the diverter valve 34, and thereby opening the right chute 36 while closing the left chute 35. It requires very little time to change the direction in which to throw the snow S, thus causing little waiting time. Thus snow removing workability is improved.

Throwing the snow S in the range of Y2 to the right as shown by arrow ⑥ upon shifting provides a passage between safety fences P1, P2.

Once the snow S in the range of Y2 has been thrown to the right, the control lever 39 is turned to the left as shown by arrow ⑦, shifting the diverter valve 34, thereby opening the left chute 35 while closing the right chute 36 instantaneously. Thus it takes very little time to change the direction, causing little waiting time. Workability of snow removal is improved.

Snow S in the range of Y3 is thrown to the left with the operation of the diverter valve 34.

The snow removal continues, throwing snow from the left chute 35 or right chute 36, appropriately, by shifting the diverter valve 34 in the manner above, and the snow removal machine 10 returns as shown in an imaginary line, throwing snow S in the range of Yn to the right, and continues back and forth.

As shown in FIG. 4, the snow removal machine 10 has a diverter valve 34 allowing snow throwing from either the left chute 36 or the right chute 35. Thus it requires very little time to change the direction in which to throw snow, significantly lessening waiting time even with frequent changes in direction. This improves workability in snow removal.

As shown in FIG. 2, the chute 25 consists generally of the main chute 31, the forked portion 33, the diverter valve 34, and the left and right chutes 35, 36 extending from the forked portion 33, having very simple structure and thereby being easily produced. The production costs of the snow removal machine 10 are thus reduced.

As shown in FIG. 1, since the chute 25 itself does not rotate, the chute 25 can also serve as a member for holding the headlights 26. This increases freedom of design in mounting the headlights 26, allowing for a flexible arrangement of the headlights 26 in design consideration.

Now a diverter valve according to another embodiment of the present invention will be described.

Figure 5:
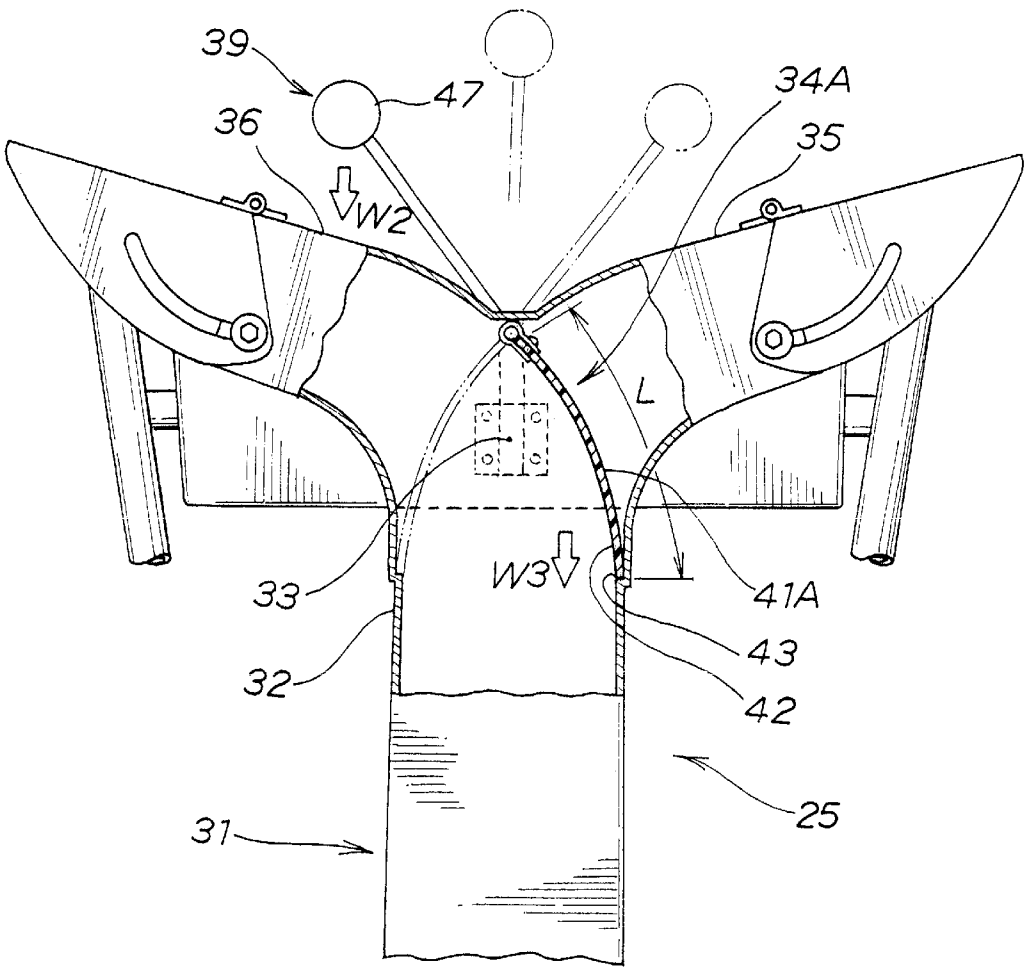
FIG. 5 is a partly sectional view of a chute with a diverter valve made from a resin material according to a second embodiment of the present invention.

FIG. 5 shows a chute 25 according to the second embodiment. Like reference numerals are given to like members as in the chute 25 in the first embodiment shown in FIG. 2, and details thereof are omitted.

A diverter valve 34A has a valve body 41A provided to a forked portion 33. Seat steps 43 with which a distal end 42 of the valve body 41A comes into close contact are formed at an outlet 32 of a main chute 31.

The valve body 41A has a length L and a width (in a forward/backward direction) which allows the body 41A to come into contact with the inner surface of the main chute 31. The valve body 41B has a weight W3. The weight W3 is smaller than W2 (W3<W2). The material of the valve body 41B is resin.

In this figure, the control lever 39 is turned to the right, opening the right chute 36.

As shown in FIG. 5, since the valve body 41A of the diverter valve 34A is made from resin, the valve 34A can flexibly bend to form a continuous curve with the curve of either the left chute 35 or the right chute 36. The diverter valve 34A bends more flexibly under air pressure, allowing for a smooth flow of snow.

The valve body 41A is made from resin, thus having a lighter weight.

The present disclosure relates to the subject matter of Japanese Patent Application No. 2000-365402, filed Nov. 30, 2000, the disclosure of which is incorporated herein by reference in its entirety.

What is claimed is:

1. A chute for a snow removal machine, for guiding the throwing of snow raked in from a road surface in a desired direction, said chute comprising:

a main chute uprightly provided on a body of said snow removal machine;

a forked portion provided at an outlet of said main chute;

a diverter valve provided in said forked portion; and a left chute and a right chute extending to the left and right from said forked portion, said diverter valve being capable of shifting to enable snow to be thrown from either said left chute or said right chute.

2. A chute according to claim 1, wherein, said diverter valve is shifted with a control lever connected to said diverter valve.

3. A chute according to claim 1, wherein, said diverter valve is made from a thin steel material.

4. A chute according to claim 1, wherein, said diverter valve is made from a resin material.

* * * * *